US005848639A

United States Patent [19]

Flesburg et al.

[11] Patent Number: 5,848,639

[45] Date of Patent: Dec. 15, 1998

[54] NON-METALLIC FLOW DIVIDER

[75] Inventors: Edward E. Flesburg; Raymond D. Stratton; Steven M. Shaffer, all of Peoria, Ill.; Douglas B. Penney, Waterford, Wis.

[73] Assignees: Caterpillar, Inc., Peoria, Ill.; Modine Manufacturing Company, Racine, Wis.

[21] Appl. No.: 788,682

[22] Filed: Jan. 24, 1997

[51] Int. Cl.[6] ..... F28D 7/16

[52] U.S. Cl. ..... 165/176; 165/174

[58] Field of Search ..... 165/151, 153, 165/173, 174, 176

[56] References Cited

U.S. PATENT DOCUMENTS

| | | | |
|---|---|---|---|
| 2,225,856 | 12/1940 | Buck . | |
| 2,351,425 | 6/1944 | Hanson | 165/176 X |
| 3,311,164 | 3/1967 | Cox et al. . | |
| 3,324,941 | 6/1967 | Divers . | |
| 3,332,479 | 7/1967 | Martin, Jr. . | |
| 3,572,429 | 3/1971 | Myers | 165/176 X |
| 3,628,603 | 12/1971 | Fieni | 165/151 |
| 4,190,101 | 2/1980 | Hartmann | 165/176 X |
| 4,328,862 | 5/1982 | Gossalter . | |
| 4,520,868 | 6/1985 | Grawey . | |
| 4,625,793 | 12/1986 | Cadars | 165/151 |
| 4,643,249 | 2/1987 | Grawey . | |
| 4,651,820 | 3/1987 | Knapp | 165/176 X |
| 5,022,465 | 6/1991 | Baines | 165/176 |
| 5,137,080 | 8/1992 | Haasch et al. . | |

FOREIGN PATENT DOCUMENTS

| | | | |
|---|---|---|---|
| 518224 | 12/1992 | European Pat. Off. | 165/176 |
| 1089816 | 3/1955 | France . | |

*Primary Examiner*—Leonard R. Leo
*Attorney, Agent, or Firm*—Wood, Phillips, VanSanten, Clark & Mortimer

[57] ABSTRACT

A heat exchanger includes a first header and tank assembly having an inlet port and an outlet port. First and second tubes are included, each tube in fluid communication with the first header and tank assembly and with the other tube. An elastomeric baffle is disposed in the first header and tank assembly to substantially prevent fluid flow between the inlet port and the outlet port except through the first and second tubes.

11 Claims, 3 Drawing Sheets

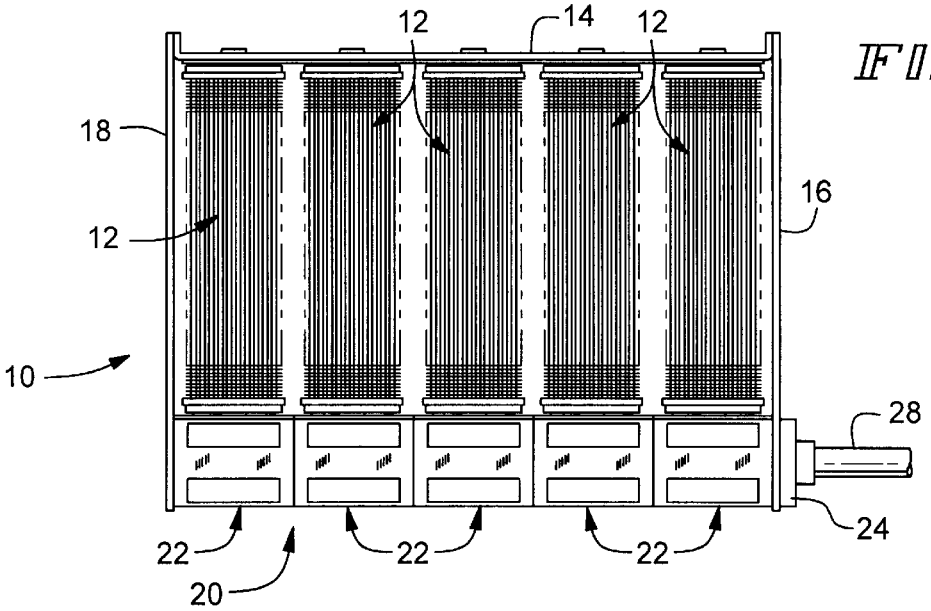
FIG. 1
FIG. 2
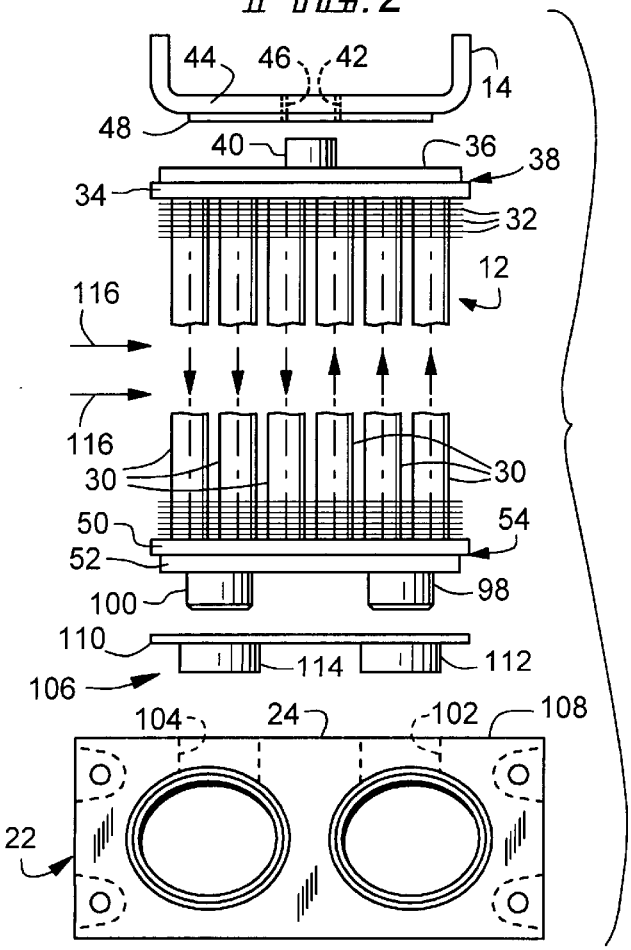
FIG. 3
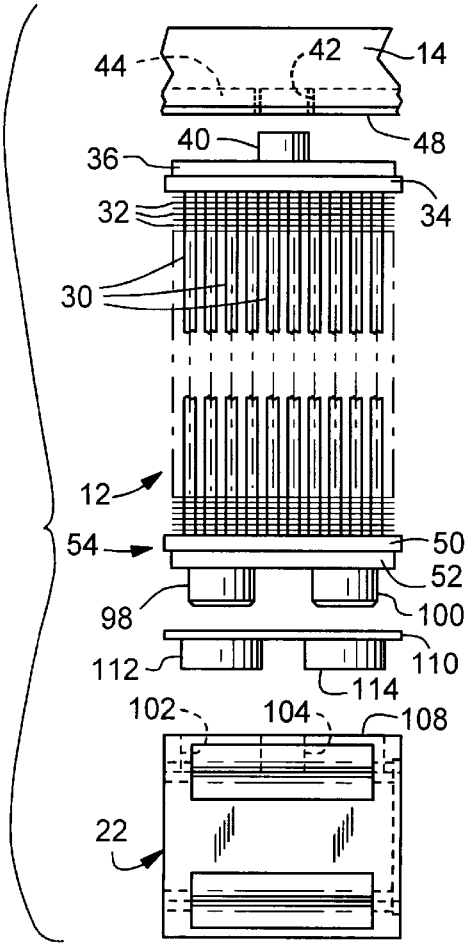

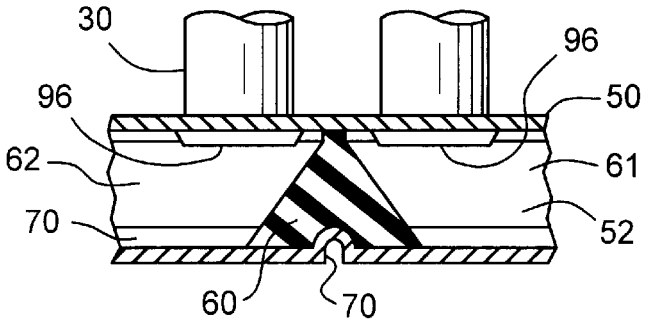
FIG. 4
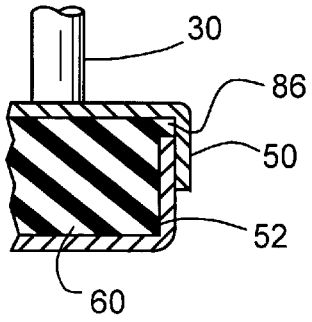
FIG. 5
FIG. 6
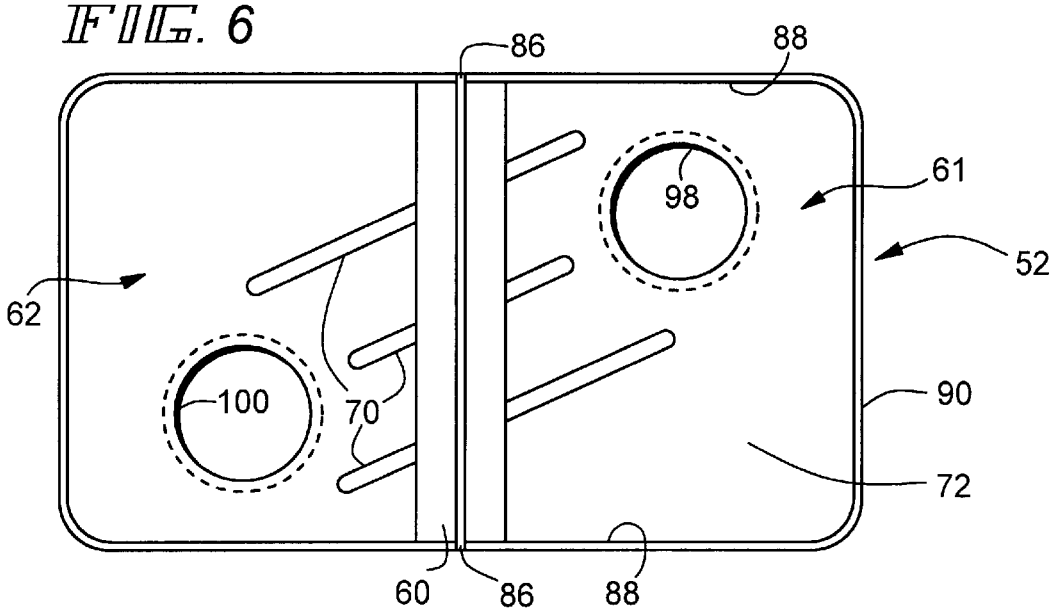
FIG. 7
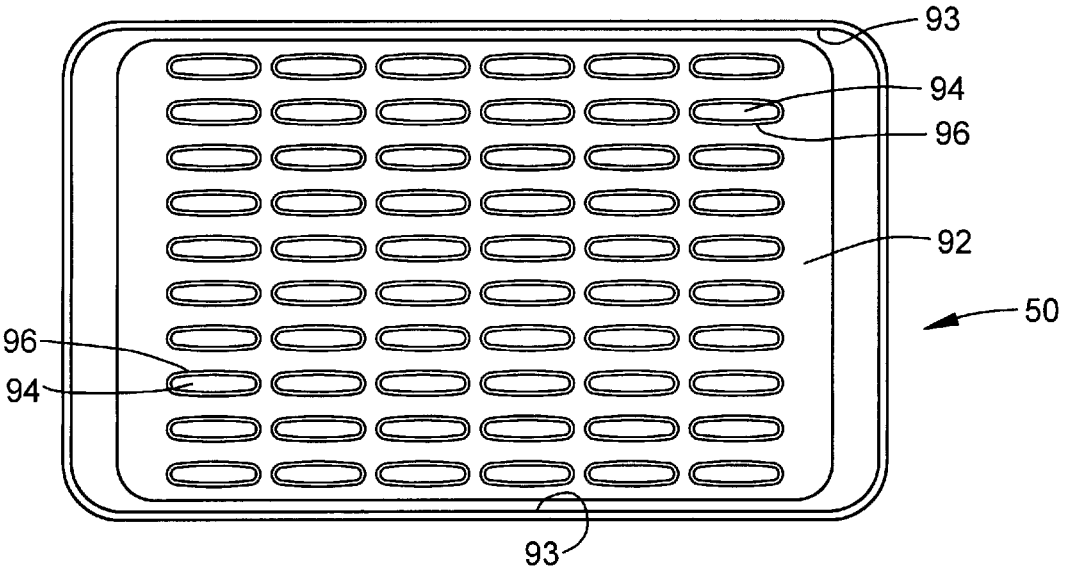

NON-METALLIC FLOW DIVIDER

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

1. Technical Field

This invention relates to heat exchangers, and more particularly, to heat exchanger flow dividers used for directing the flow of a first heat exchange fluid within a heat exchanger.

2. Background Art

In a two-pass heat exchanger such as is illustrated by Haasch et al. in U.S. Patent No. 5,137,080, the entire disclosure of which is herein incorporated by reference, a heat exchange fluid flows through a system consisting of a first header and tank assembly, a first plurality of tubes, a second header and tank assembly, and a second plurality of tubes. As is shown by Haasch et al., the first header and tank assembly, which has an inlet and an outlet, is divided into two separate compartments by a flow divider or baffle. One compartment is in direct fluid communication with the inlet and the other compartment is in direct fluid communication with the outlet. However, fluid communication between the first compartment and the second compartment is substantially prevented by the flow divider.

In operation, the heat exchange fluid flows from the inlet through the first compartment of the first header and tank assembly and into the first plurality of tubes. The heat exchange fluid then flows through the second header and tank assembly and into the second plurality of tubes. The heat exchange fluid flowing through and out of the second plurality of tubes enters the second compartment of the first header and tank assembly. The heat exchange fluid from the second compartment of the first header and tank assembly is then removed from the heat exchanger through the outlet in the first header and tank assembly.

The first header and tank assembly is usually manufactured as two pieces, a tank and a header. The flow divider or baffle is typically either welded to or formed integrally with the tank. Conventionally, the flow divider or baffle is made at least partially of a metallic substance, such as brass, which may be combined with a non-metallic substance, such as silicone rubber.

The heat exchange fluid typically enters the heat exchanger at a very high temperature. The high temperature, as well as the type of heat exchange fluid used and the presence of contaminants in the heat exchange fluid, can cause corrosion of the baffle over time. If the baffle is sufficiently corroded, flow may occur between the first and second compartments of the first header and tank assembly. As a result, the efficiency of the heat exchanger may be degraded.

Depending on the degree of corrosion, it may be necessary to disassemble the heat exchanger. The disassembly of the heat exchanger is generally a sophisticated operation which is not usually performed in the field. Where the heat exchanger is, for example, a vehicular radiator, the time needed to repair and/or replace the heat exchanger decreases the time the vehicle is available to perform useful work.

The present invention is directed to overcoming one or more of the above problems.

BRIEF SUMMARY OF THE INVENTION

It is the principal object of the invention to provide a new and improved flow divider or baffle.

Therefore, in one embodiment of the invention, a heat exchanger includes a first header and tank assembly having an inlet port and an outlet port. First and second tubes are included, each tube in fluid communication with the first header and tank assembly and with the other tube. An elastomeric baffle is disposed in the first header and tank assembly to substantially prevent fluid flow between the inlet port and the outlet port except through the first and second tubes.

Moreover, the first and second tubes may each have a first end in fluid communication with the first header and tank assembly. The first header and tank assembly includes an apertured header receiving the first ends and a tank attached to the header. The baffle is disposed between the header and the tank, the header and the tank elastically compressing the baffle between opposing surfaces on the header and the tank.

The heat exchanger may also include a second header and tank assembly including an apertured header and a tank attached to the header. The first and second tubes each have a second end in fluid communication with the second header and tank assembly, the second ends of the first and second tubes being received in the apertures in the header of the second header and tank assembly.

The tank preferably has a rib formed in the opposing surface of the tank and directed toward the header, the baffle having an indentation therein which conforms to and receives the rib to locate the baffle in a desired position between the inlet port and the outlet port.

The baffle may also have a first substantially planar side which abuts the opposing surface of the tank. The baffle also has two sides adjacent the first side which slope upwardly from the first side to an apex, the apex abutting the opposing surface of the header.

Further, the tank may have a rim opposite the opposing surface of the tank. The baffle has tabs which extend outwardly from the apex of the baffle and abut the rim. The tabs are elastically compressed between the header and the tank.

Additionally, the tank may have opposing sides which extend outwardly from the opposing surface of the tank. The baffle is disposed between the opposing sides such that the baffle is elastically compressed between the opposing sides.

The baffle may also have first and second ends facing the opposing sides of the tank. The first and second ends each may have a rib formed integrally therewith extending outwardly from the end of the baffle. The ribs abut the opposing sides of the tank and are elastically compressed between the opposing sides of the tank.

Additionally, in a highly preferred embodiment, the elastomeric baffle is made from nitrile rubber having a hardness of about 70 durometer as measured on a Shore A scale.

Additionally, the first and second tubes may have flattened sides, and the baffle may be elongated and generally transverse to the flattened sides.

In another embodiment of the invention, a heat exchanger includes a first header and tank assembly having an inlet port and an outlet port. The first header and tank assembly has an apertured header and a tank attached to the header. First and second tubes are included, each tube having an end in fluid communication with the first header and tank assembly. The ends of the first and second tubes received in the apertured header. An elastomeric baffle is disposed in the first header and tank assembly to substantially prevent fluid flow between the inlet port and the outlet port except through the first and second tubes. The tank and the header compress the baffle between opposing surfaces on the header and the tank.

According to this embodiment of the invention, the tank may have opposing sides which extend outwardly from the opposing surface of the tank. The baffle is disposed between the opposing sides such that the baffle is elastically compressed between the opposing sides.

In a still further embodiment of the invention, a module for a modular heat exchanger includes a first apertured header and a first tank attached to the apertured header. The first tank has an inlet nipple and an outlet nipple. A second apertured header and a second tank attached to the apertured header are also included, the second tank having a positioning snout. Rows of flattened tubes are included, each flattened tube having a first end in fluid communication with the first header and a second end in fluid communication with the second header. An elastomeric baffle is disposed in the first tank between the inlet nipple and the outlet nipple and is elastically compressed between facing surfaces of the first header and the first tank to substantially prevent fluid flow between the inlet nipple and the outlet nipple except through the rows of flattened tubes.

According to this embodiment of the invention, the baffle may have an enlarged base and a narrow nose. The enlarged base abuts the facing surface of the first tank. The narrow nose abuts the facing surface of the first header.

The first tank may further have a rib formed in the facing surface and directed toward the header, facing sides which extend outwardly from the facing surface, and a rim opposite the facing surface of the tank. The baffle has an indentation formed in the enlarged base which conforms to and receives the rib to locate the baffle in a desired position between the inlet nipple and the outlet nipple. The baffle has first and second triangular ends each having a rib formed integrally therewith extending outwardly from the end of the baffle, the ribs being elastically compressed between the facing sides. The baffle has tabs which extend outwardly from the narrow nose of the baffle and abut the rim, the tabs being elastically compressed between the first header and the first tank.

BRIEF DESCRIPTION OF THE SEVERAL VIEWS OF THE DRAWINGS

FIG. 1 is an elevation of a modular heat exchanger incorporating a flow divider or baffle according to the present invention, the modular heat exchanger having a plurality of modules;

FIG. 2 is an exploded, side elevation of one of the modules;

FIG. 3 is an exploded, front elevation of the module shown in FIG. 2;

FIG. 4 is a fragmentary, enlarged, sectional view of one of the header and tank assemblies used in the module shown in FIGS. 2 and 3;

FIG. 5 is a fragmentary, enlarged, sectional view of one of the header and tank assemblies used in the module shown in FIGS. 2 and 3 taken at 90° to FIG. 4;

FIG. 6 is an enlarged, plan view of the tank used in the header and tank assembly shown in FIGS. 4 and 5 with the baffle in place in the tank;

FIG. 7 is an enlarged, plan view of the header used in the header and tank assembly shown in FIGS. 4 and 5;

DETAILED DESCRIPTION OF THE INVENTION

Figure 8:
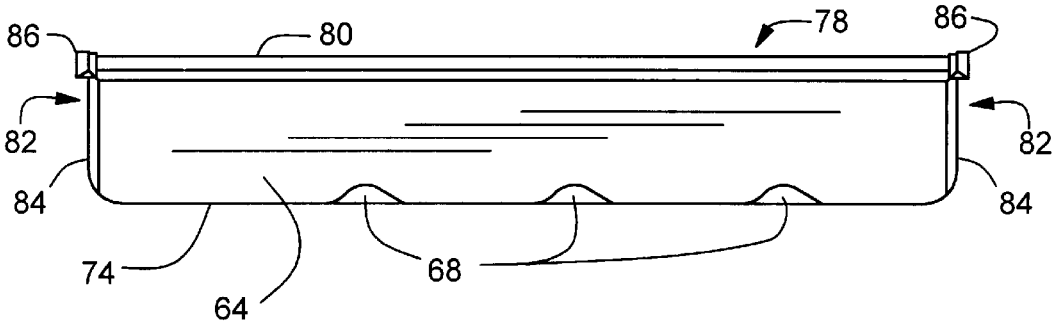
FIG. 8 is a side elevation of an embodiment of an elastomeric baffle according to the present invention.

An exemplary embodiment of a modular heat exchanger incorporating a flow divider or baffle made according to the present invention is illustrated in FIG. 1. The modular heat exchanger includes a frame 10 which receives a plurality of individual heat exchange modules 12. Typically, but not always, the modules 12 will all be of equal length as shown in FIG. 1.

The frame 10 includes an upper, tank retainer 14 which is in the form of an elongated, upwardly-opening U-shaped bar. At its ends, the tank retainer 14 is releasably joined to right and left side pieces 16 and 18. Lowermost in the frame 10 is a lower frame member or manifold 20.

As illustrated, the manifold 20 is made up of a plurality of manifold modules 22. However, a one piece manifold is specifically contemplated. At one end, the manifold 20 may have mounted thereto an inlet/outlet fitting 24, which, in turn, is connected to an inlet conduit (not shown) and an outlet conduit 28.

As shown in FIGS. 2 and 3, each module 12 includes a plurality of tubes 30 of oval or flattened cross-section. As illustrated in FIGS. 2 and 3, there are six rows of ten tubes 30 in each module 12. Fins 32 extend between the exteriors of the tubes 30 in the various rows. As illustrated, the fins 32 are plate fins, but it will be appreciated by those skilled in the art that serpentine fins could also be employed.

At the upper end of each of the tubes 30 is an upwardly opening, cup-shaped header 34 through which the tubes 30 extend and to which the tubes 30 may be bonded and sealed in any desired fashion. A downwardly opening, shallow, cup-shaped tank 36 is received within the header 34 and sealed thereto.

In the embodiment illustrated, the header 34 and tank 36 are made of metal such as copper or brass and may be soldered, welded or brazed together. However, it should be appreciated that plastic components may be utilized as well. In any event, the header 34 and the tank 36 define an upper header and tank assembly 38 at the end of the tubes 30.

Projecting upwardly from the upper exterior surface of the tank 36 is a positioning snout or stud 40. The stud 40 is adapted to be received in an aperture 42 within the bight 44 of the tank retainer 14. Desirably, a resilient bushing 46 is interposed between the sides of the aperture 42 and the stud 40 for vibration isolation purposes. A resilient pad 48 is positioned between the underside of the bight 44 and the upper surface of the tank 36 to serve as a vibration damper. The bushing 46 and the pad 48 may be integrally formed.

Oppositely of the header and tank assembly 38 defined by the header 34 and the tank 36, the tubes 30 terminate in a second header 50 in which the ends of the tubes 30 are bonded and sealed as to the header 34. Like the header 34, the header 50 is somewhat cup-shaped, but opens downwardly to receive a shallow, cup-shaped upwardly opening tank 52. Again, the components are of a metal such as copper or brass, but may be of plastic if desired. The header 50 and the tank 52 define a lower header and tank assembly 54.

Within the lower header and tank assembly 54 and midway between the rows of tubes 30, is an elongated flow divider or baffle 60. The baffle 60 is disposed between three rows to the left and three rows to the right, dividing the lower header and tank assembly 54 into substantially equal volume first and second compartments 61, 62 (FIGS. 4 and 6). In embodiments having an odd number of tube rows, the compartments 61, 62 will not be of equal volume.

Figure 10:
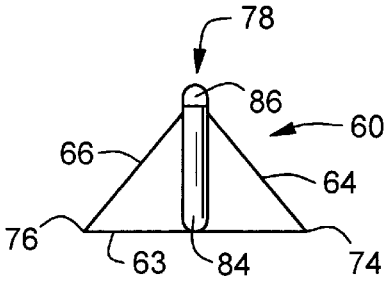
FIG. 10 is an end elevation of the elastomeric baffle taken at 90° to FIG. 8.
Figure 9:
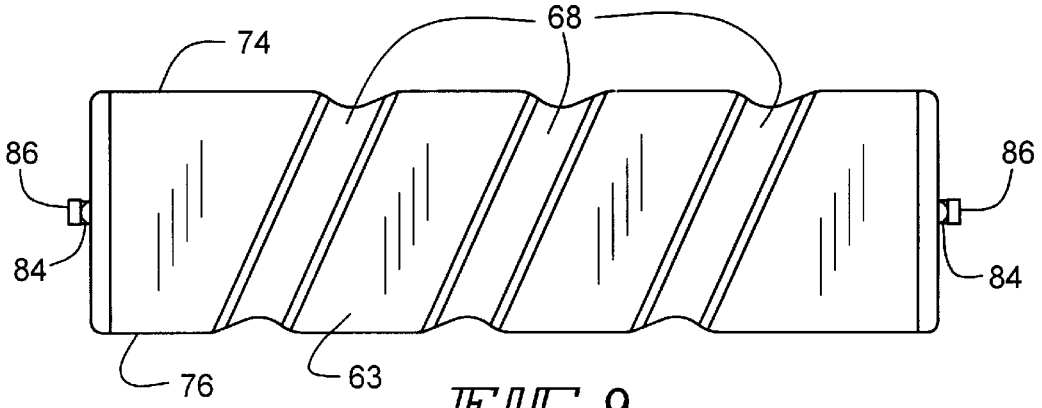
FIG. 9 is a bottom view of the elastomeric baffle.

The baffle 60 has first, second and third substantially planar sides 63, 64, 66 (FIGS. 8–10). The first side 63 has three indentations 68 formed therein. When the baffle 60 is disposed in the tank 52, the indentations 68 align the baffle 60 within the tank 52 along strengthening ribs 70 formed in the bottom interior surface 72 of the tank 52 (FIG. 6) so that the baffle 60 is positioned near the center of the tank 52. The ribs 70 are employed to prevent substantial flexing of the tank in response to pressure changes therein.

The second and third sides 64, 66 adjoin the first side 63 at edges 74, 76, at an enlarged base and slope inwardly therefrom to an apex or narrow nose 78. Typically, the sides 64, 66 have the same slope and meet at a ridge 80 of substantially uniform cross-section formed at the apex 78. In the exemplary embodiment of the present invention, the ridge 80 has a uniform D-shaped cross-section, as seen in FIGS. 4 and 10.

At either end of the baffle 60 is a planar end 82 of substantially triangular shape. As shown in FIGS. 8 and 10, ribs 84 located on both ends of the baffle 60 extend from the first side 63 of the baffle 60 to the apex 78. The ribs 84 shown are of substantially uniform cross-section, and in particular, have a D-shaped cross-section (FIG. 9).

With respect to FIGS. 8 and 9, it can also be seen that the ridge 80 formed at the apex 78 extends outwardly at both ends 82 beyond the rib 84. The extensions thus define a pair of tabs 86 of substantially uniform D-shaped cross-section (FIG. 10).

In assembling the heat exchange module 12, the baffle 60 is placed in the tank 52 such that the indentations 68 align with the ribs 70 formed in the bottom interior surface 72 of the tank 52. The ribs 84 at either end 82 of the baffle 60 are compressed inwardly by opposing sides 88 of the tank 52 as the baffle 60 is forced downwardly into the tank 52. With the baffle 60 disposed within the tank 52 such that the first side 63 abuts the bottom interior surface 72, the ribs 84 are compressed substantially along their entire length. The tabs 86, however, extend over a rim 90 of the tank 52 to seal the space between the rim 90 and the bottom interior surface 92 of the header 50 (FIG. 5). They are compressed between the surface 92 and the rim 90 as well by the side walls 93 of the header 50, and are therefore not placed into compression between the sides 88.

The header 50 is then placed onto the tank 52. The header 50 is then forced downwardly onto the tank 52 such that the tabs 86 are placed into compression between the bottom interior surface 92 of the header 50 and the rim 90 of the tank 52. The ridge 80 along the apex 78 of the baffle 60 is also forced downwardly when the header 50 is placed onto the tank 52. As a result, the ridge 80 and the baffle 60 are compressed between the bottom interior surface 72 of the tank 52 and the bottom interior surface 92 of the header 50.

As can be seen in FIGS. 4 and 7, the header 50 has a number of holes 94 formed therethrough, each hole 94 surrounded by a downwardly depending flange 96. With the baffle 60 properly disposed between the header 50 and the tank 52 on the ribs 70, the ridge 80 will be disposed between the flanges 96 of two adjacent rows of flanges 96 as shown in FIG. 4.

The baffle 60 is made of an elastomeric material. When the heat exchanger is used as a radiator for an internal combustion engine, one suitable material for the baffle 60 is nitrile rubber, having a hardness reading of 70 durometer on the Shore A scale. Nitrile rubber is used because nitrile rubber is non-reactive with typical coolants used in vehicular radiators, as well as common contaminants, such as diesel fuel, which may become mixed with the coolant. Alternatively, highly saturated nitrile rubber (HNBR or butadiene acrylonitrile) may be used.

As seen in FIG. 6, on one side of the baffle 60 is a downwardly-extending nipple 98 which serves as an inlet to the lower header and tank assembly 54. The nipple 98 is in fluid communication with the first compartment 61. On the opposite side of the baffle 60 is a downwardly extending nipple 100 which serves as an outlet, and is in fluid communication with the second compartment 62.

Because of the presence of the baffle 60, it will be appreciated that the first heat exchange fluid entering the module 12 through the nipple 98 cannot flow directly to the nipple 100 through the lower header and tank assembly 54, i.e. from the first compartment 61 directly to the second compartment 62. Rather, the first heat exchange fluid must flow upwardly through the rightmost three rows of tubes 30 as viewed in FIG. 2 to the upper header and tank assembly 38. At this point, the first heat exchange fluid may flow to the left through the upper header and tank assembly 38, and descend through the leftmost three rows of tubes 30, ultimately to exit through the second compartment 62 of the lower header and tank assembly 54 and the nipple 100.

The nipples 98, 100 are adapted to be received in respective female ports or bores 102, 104 in one of the manifold modules 22. For sealing purposes, a seal 106 is interposed between the tank 52 and the upper surface 108 of each of the manifold modules 22. Each seal 106 includes a flat planar section 110 and two generally cylindrical sections 112, 114 which depend from the flat section 110. The cylindrical sections 112, 114 are sized to fit within the female ports 102, 104 to seal the sides of the female ports 102, 104 against the sides of the nipples 98, 100. The flat section 110 serves to seal and isolate the manifold module 22 from the modules 12 for vibration isolation purposes.

In operation, as described above, the first heat exchange fluid enters the heat exchanger 10 through the inlet conduit (not shown), and then enters the manifold 20. Passing through the manifold 20, the first heat exchange fluid enters each of the modules 12 via the nipple 98. In each module 12, the first heat exchange fluid passes through the nipple 98 into the first compartment 61 of the lower header and tank assembly 54.

The first heat exchange fluid then passes through the tubes 30, into the upper header and tank assembly 38, and then back into the tubes 30 heading toward the second compartment 62 of the lower header and tank assembly 54. As the first heat exchange fluid passes through the tubes 30, a second heat exchange fluid, such as air, is passed over the fins 32 and the tubes 30 in the direction of the arrows 116 in FIG. 2. When the heat exchanger is used as a radiator, the first exchange fluid thus begins at the back or downstream side of the module 12 and flows forwardly to provide a counterflow arrangement along with a two-pass arrangement by reason of the provision of the baffle 60.

Upon reaching the second compartment 62, the first heat exchange fluid exits the module 12 through the nipple 100. The first heat exchange fluid is then transferred through the manifold 20 to the inlet/outlet fitting 24, whereupon the first heat exchange fluid exits the heat exchanger through the outlet conduit 28.

The invention described above achieves the desired goal of prevention of bypass of fluid between the first and second compartments of the lower header and tank assembly 54 while substantially decreasing the risk of corrosion. By forming the baffle from an elastomeric material, such as a nitrile rubber, the baffle is substantially corrosion-resistant.

We claim:

1. A heat exchanger comprising:

a first header and tank assembly having an inlet port and an outlet port;

the first header and tank assembly including an apertured header and a tank attached to the header;

first and second tubes, each tube in fluid communication with the first header and tank assembly and with the other tube;

the first and second tubes each having a first end in fluid communication with and received in the apertured header;

an elastomeric baffle disposed in the first header and tank assembly to substantially prevent fluid flow between the inlet port and the outlet port except through the first and second tubes;

the baffle being disposed between the header and the tank, the header and the tank elastically compressing the baffle between opposing surfaces on the header and the tank;

the tank having a rib formed in the opposing surface of the tank and directed toward said header; and the baffle having an indentation therein which conforms to and receives the rib to locate the baffle in a desired position between the inlet port and the outlet port.

2. A heat exchanger according to claim 1, further comprising:

a second header and tank assembly including an apertured header and a tank attached to the header;

the first and second tubes each having a second end in fluid communication with the second header and tank assembly; and the second ends of the first and second tubes being received in the apertures in the header of the second header and tank assembly.

3. A heat exchanger according to claim 2, wherein the elastomeric baffle is nitrile rubber having a hardness of about 70 durometer as measured on the Shore A scale.

4. A heat exchanger according to claim 2, wherein the first and second tubes have flattened sides; and the baffle is elongated and is generally transverse to the flattened sides.

5. A heat exchanger comprising:

a first header and tank assembly having an inlet port and an outlet port;

the first header and tank assembly including an apertured header and a tank attached to the header;

first and second tubes, each tube in fluid communication with the first header and tank assembly and with the other tube;

the first and second tubes each having a first end in fluid communication with and received in the apertured header;

an elastomeric baffle disposed in the first header and tank assembly to substantially prevent fluid flow between the inlet port and the outlet port except through the first and second tubes;

the baffle being disposed between the header and the tank, the header and the tank elastically compressing the baffle between opposing surfaces on the header and the tank;

the baffle having a first substantially planar side which abuts the opposing surface of the tank;

the baffle also having two sides adjacent the first side which slope upwardly from the first side to an apex; and the apex abutting the opposing surface of the header.

6. A heat exchanger according to claim 5, wherein the tank has a rim opposite the opposing surface of the tank;

the baffle has tabs which extend outwardly from the apex of the baffle and abut the rim; and the tabs are elastically compressed between the header and the tank.

7. A heat exchanger comprising:

a first header and tank assembly having an inlet port and an outlet port;

the first header and tank assembly including an apertured header and a tank attached to the header;

first and second tubes, each tube in fluid communication with the first header and tank assembly and with the other tube;

the first and second tubes each having a first end in fluid communication with and received in the apertured header;

an elastomeric baffle disposed in the first header and tank assembly to substantially prevent fluid flow between the inlet port and the outlet port except through the first and second tubes;

the baffle being disposed between the header and the tank, the header and the tank elastically compressing the baffle between opposing surfaces on the header and the tank;

the tank having opposing sides which extend outwardly from the opposing surface of the tank;

the baffle being disposed between the opposing sides such that the baffle is elastically compressed between the opposing sides;

the baffle having first and second ends facing the opposing sides of the tank;

the first and second ends each having a rib formed integrally therewith extending outwardly from the end of the baffle; and the ribs abutting the opposing sides of the tank and are elastically compressed between the opposing sides of the tank.

8. A heat exchanger comprising:

a first header and tank assembly having an inlet port and an outlet port;

the first header and tank assembly including an apertured header and a tank attached to the header;

the header and the tank having opposing surfaces;

first and second tubes, each tube having an end in fluid communication with the first header and tank assembly;

the ends of the first and second tubes received in the apertured header;

an elastomeric baffle disposed in the first header and tank assembly to substantially prevent fluid flow between the inlet port and the outlet port except through the first and second tubes;

the baffle having a first surface abutting one of the opposing surfaces of the header and the tank;

the tank and the header compressing the baffle between the opposing surfaces on the header and the tank; and means for locating the baffle relative to the header and tank assembly;

the means for locating the baffle including at least one protuberance on one of the surface of the baffle and the one of the opposing surfaces, and at least one protuberance receiving recess on the other of the surface of the baffle and the one of the opposing surfaces, the protuberance being received in the recess.

9. The heat exchanger according to claim 1, wherein the tank has opposing sides which extend outwardly from the opposing surface of the tank; and the baffle is disposed between the opposing sides such that the baffle is elastically compressed between the opposing sides.

10. A module for a modular heat exchanger comprising:

a first apertured header;

a first tank attached to the apertured header;

the first tank including an inlet nipple and an outlet nipple;

a second apertured header;

a second tank attached to the apertured header;

the second tank including a positioning snout;

rows of flattened tubes, each flattened tube having a first end in fluid communication with the first header and a second end in fluid communication with the second header;

an elastomeric baffle disposed in the first tank between the inlet nipple and the outlet nipple and elastically compressed between facing surfaces of the first header and the first tank to substantially prevent fluid flow between the inlet nipple and the outlet nipple except through the rows of flattened tubes;

the baffle having an enlarged base and a narrow nose;

the enlarged base abutting the facing surface of the first tank; and the narrow nose abutting the facing surface of the first header.

11. A module according to claim 10, wherein the first tank has a rib formed in the facing surface and directed toward the header, facing sides which extend outwardly from the facing surface, and a rim opposite the facing surface of the tank;

the baffle has an indentation formed in the enlarged base which conforms to and receives the rib to locate the baffle in a desired position between the inlet nipple and the outlet nipple;

the baffle has first and second triangular ends each having a rib formed integrally therewith extending outwardly from the end of the baffle, the ribs being elastically compressed between the facing sides; and the baffle has tabs which extend outwardly from the narrow nose of the baffle and abut the rim, the tabs being elastically compressed between the first header and the first tank.

* * * * *